US006905304B2

(12) United States Patent
Park

(10) Patent No.: US 6,905,304 B2
(45) Date of Patent: Jun. 14, 2005

(54) HEAT DISSIPATION FAN

(75) Inventor: Hee-Keun Park, Taipei (TW)

(73) Assignee: Taiwan TriGem Information Co., Ltd., Taipei (TW)

( * ) Notice: Subject to any disclaimer, the term of this patent is extended or adjusted under 35 U.S.C. 154(b) by 0 days.

(21) Appl. No.: 10/669,946

(22) Filed: Sep. 23, 2003

(65) Prior Publication Data

US 2005/0063817 A1 Mar. 24, 2005

(51) Int. Cl.[7] ..... F04D 25/24
(52) U.S. Cl. ..... 415/173.1; 415/206
(58) Field of Search ..... 415/197, 173.1, 415/203, 206, 914

(56) References Cited

U.S. PATENT DOCUMENTS 4,108,139 A * 8/1978 Gilliom et al. ..... 126/21 A
5,228,850 A * 7/1993 Hoetzl et al. ..... 432/176

* cited by examiner

*Primary Examiner*—Ninh H. Nguyen

(57) ABSTRACT

A heat dissipation fan includes a casing having a bottom wall and a side wall extending from the bottom wall and defining an open top of the casing. The side wall itself defines a side opening. A rotary fan assembly is housed in the casing and is rotatably supported on the bottom wall. The fan assembly includes fan blades that are spaced from the bottom wall of the casing whereby a gap is formed therebetween. Air is drawn into the casing by the fan blades via the open top of the casing and driven out of the casing through the side opening. A stuffing pad is arranged in the gap and positioned on the bottom wall to reduce the gap wherein air flowing to the back side of the fan blades is limited and turbulence induced thereby is alleviated. The stuffing pad is made of a soft material whereby damage may not occur on the fan blades when the fan blades impact the stuffing pad.

4 Claims, 4 Drawing Sheets

HEAT DISSIPATION FAN

BACKGROUND OF THE INVENTION

1. Field of the Invention

The present invention relates generally to a heat dissipation fan, and in particular to a heat dissipation fan having reduced turbulence induced in the back side of fan blades and enhancing protection of the blades.

2. The Related Art

Heat dissipation fans are commonly employed to enhance removal of heat generated in computers in order to maintain proper operation of the computers. A side-mount heat dissipation fan comprises a casing having an open top for intake of surrounding air and a side opening in communication with a heat sink to conduct air flow toward and through the heat sink. The casing has a bottom that is closed for supporting the fan blades thereon. Since the fan blades are rotated at a high speed, undesired impact of the fan blades with the bottom of the casing inevitably causes damage to the fan blades. To reduce the risk of impact, the fan blades are arranged at a sufficient distance from the bottom. This effectively overcomes the impact issue. However, a large gap is formed between the fan blades and the bottom of the casing, and air that is sucked into the fan in an axial direction may flow to the back side of the fan blades instead of being driven out of the fin along the side opening by centrifugal force. The air that flows to the back side of the fan blades induces turbulence that interferes with the air flowing toward the side opening and thus reducing the operation efficiency of the fan.

The present invention is thus aimed to overcome the problem caused by the back side turbulence of a side-mount heat dissipation fan.

SUMMARY OF THE INVENTION

An object of the present invention is to provide a heat dissipation fan wherein a stuffing pad is disposed on a bottom of a casing housing a rotary fan assembly in order to substantially eliminating the distance between fan blades and the casing bottom.

Another object of the present invention is to provide a heat dissipation fan wherein a soft pad is arranged between a fan assembly and a casing to eliminate damage caused by undesired impact of the fan with the casing.

A further object of the present invention is to provide a heat dissipation fan wherein a gap between fan blades and a casing is effectively eliminated while the fan blades are maintained impact free with respect to the casing.

To achieve the above objects, in accordance with the present invention, there is provided a heat dissipation fan comprising a casing having a bottom wall and a side wall extending from the bottom wall and defining an open top of the casing. The side wall itself defines a side opening. A rotary fan assembly is housed in the casing and is rotatably supported on the bottom wall. The fan assembly comprises fan blades that are spaced from the bottom wall of the casing whereby a gap is formed therebetween. Air is drawn into the casing by the fan blades via the open top of the casing and driven out of the casing through the side opening. A stuffing pad is arranged in the gap and positioned on the bottom wall to reduce the gap wherein air flowing to the back side of the fan blades is limited and turbulence induced thereby is alleviated. The stuffing pad is made of a soft material whereby damage may not occur on the fan blades when the fan blades impact the stuffing pad.

BRIEF DESCRIPTION OF THE DRAWINGS

The present invention will be apparent to those skilled in the art by reading the following description of a preferred embodiment of the present invention, with reference to the attached drawings, in which.

DETAILED DESCRIPTION OF THE PREFERRED EMBODIMENT OF THE PRESENT INVENTION

Figure 1:
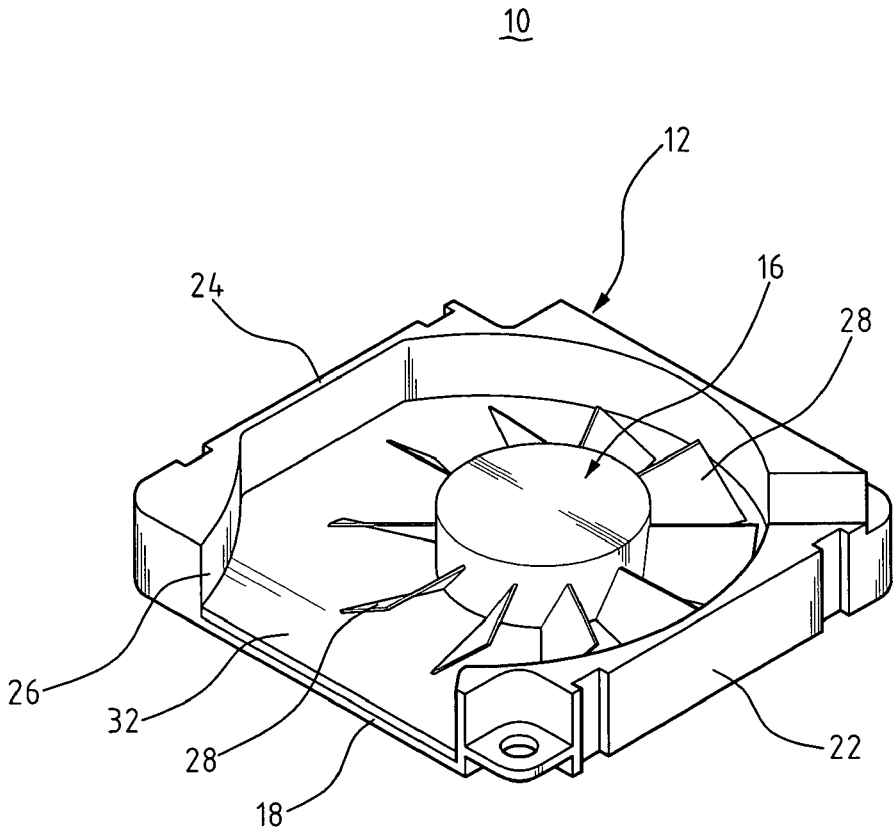
FIG. 1 is a perspective view of a heat dissipation fan constructed in accordance with the present invention.
Figure 2:
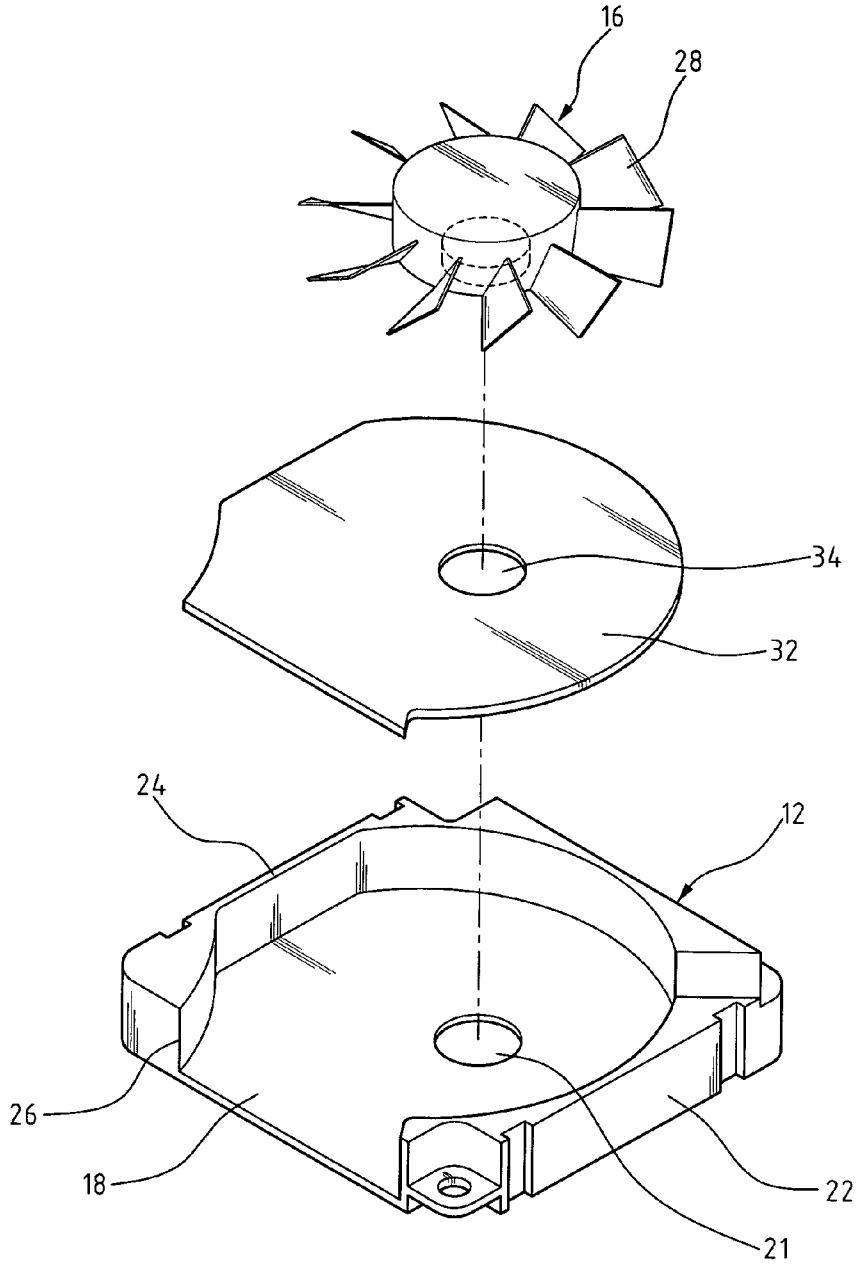
FIG. 2 is an exploded view of the heat dissipation fan of the present invention.
Figure 3:
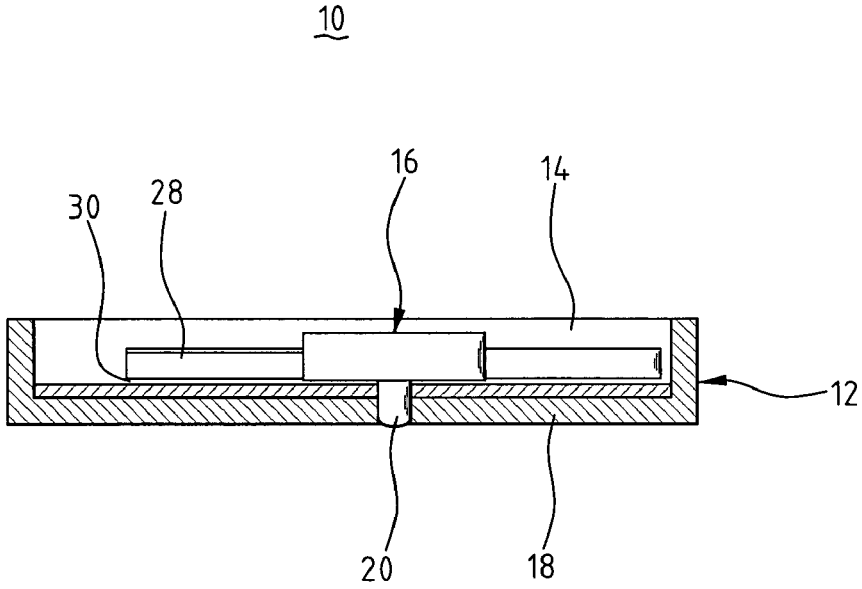
FIG. 3 is a cross-sectional view of the heat dissipation fan of the present invention.

With reference to the drawings and in particular to FIG. 1, a heat dissipation fan constructed in accordance with the present invention, generally designated with reference numeral 10, comprises a casing 12 made of a rigid material, such as metal and hard plastics. The casing 12 defines a cavity 14 in which a fan assembly 16 is received as shown in FIG. 3. The casing 12 has a bottom wall 18 on which the fan assembly 16 is rotatably supported. For example, a shaft 20 of the fan assembly 16 extends through a bore 21 defined in the bottom wall 18 as shown in FIG. 2 and supported by bearing means (not shown). Alternatively, the shaft 20 is fixed to and extends from the bottom wall 18 into the cavity 14 to which the fan assembly 16 is rotatably mounted. The casing 12 comprises a side wall 22 extending from the bottom wall 18 to define an open top 24 of the casing 12. A side opening 26 in communication with the cavity 14 is defined in the side wall 22.

Figure 4:
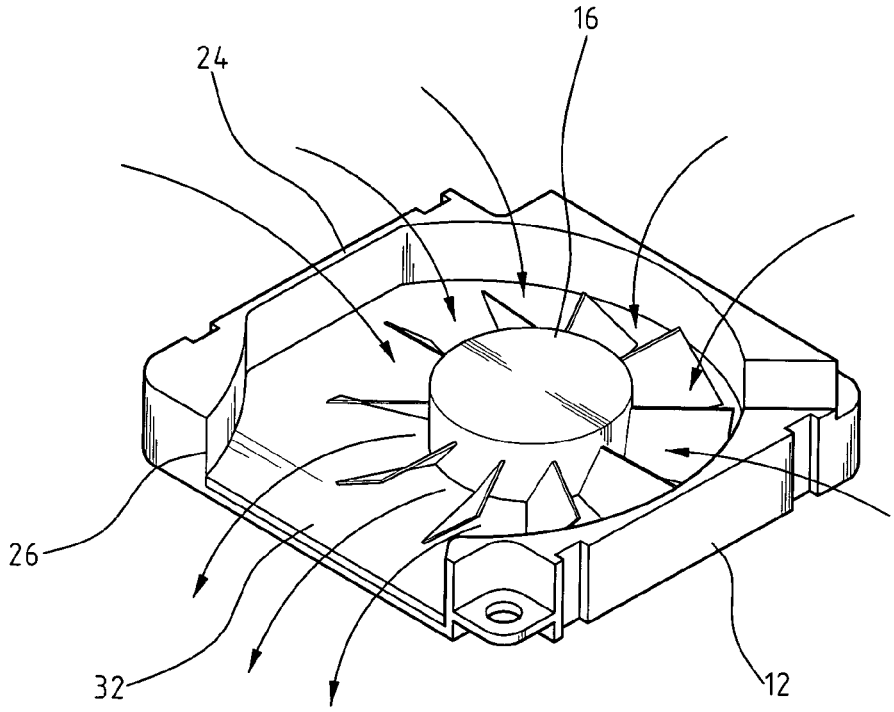
FIG. 4 is a schematic view showing the operation of the heat dissipation fan of the present invention for generation of air flow.

Also referring to FIGS. 2 and 3, the fan assembly 16 comprises a number of blades 28 which, when the fan assembly 16 rotates, draw air into the cavity 14 via the top opening 24 of the casing 12 and induce a radial flow through the side opening 26 as shown in FIG. 4. To avoid undesired impact between the fan blades 28 of the fan assembly 16 and the bottom wall 18 of the casing 12, a gap 30 is present between the fan blades 28 and the bottom wall 18, see FIG. 3.

In accordance with the present invention, a stuffing pad 32 or a layer of stuffing material is positioned on the bottom wall 18 of the casing 12 and between the bottom wall 18 and the fan blades 28 whereby the gap 30 is effectively reduced and even eliminated. The size of the gap 30 can thus be controlled by use of stuffing pads 32 of different thickness. The stuffing pad 32 defines a hole 34 for the extension of the fan shaft 20.

Since the gap 30 is reduced, impact of the fan blades 28 with the stuffing pad 32 inevitably occurs during the rotation of the fan assembly 16. To protect the fan blades 28, the stuffing pad 32 is made of a soft material, such as rubber or flexible plastics that cause no damage to the fan blades 28 when the pad 32 is hit by the fan blades 28. The stuffing pad 32 can also be in the form of a gel-like or paste-like substance supported on the bottom wall 18.

By fitting the stuffing pad 32 between the fan blades 28 and the bottom wall 18 of the casing 12, the gap 30 is substantially reduced. This in turn reduces the turbulence induced on the back side of the fan blades 28. In addition, by means of the softness or flexible characteristics of the stuffing pad 32, damage to the fan blades 28 caused by undesired impact with the stuffing pad 32 can be effectively eliminated.

Although the present invention has been described with reference to the preferred embodiment thereof, it is apparent to those skilled in the art that a variety of modifications and changes may be made without departing from the scope of the present invention which is intended to be defined by the appended claims. For example, the stuffing pad may be replaced by paste-like or gel-like substance that maintains the shape thereof during the operation of the fan.

What is claimed is:

1. A heat dissipation fan comprising:

a casing having a bottom wall;

a rotary fan assembly rotatably supported on the bottom wall, the fan assembly comprising fan blades that are spaced from the bottom wall whereby a gap is formed therebetween; and a layer of stuffing material arranged in the gap and positioned on the bottom wall to reduce the gap;

wherein the casing comprises a side wall extending from the bottom wall and defining an open top of the casing, the side wall defining a side opening, whereby air is drawn into the casing by the fan blades via the open top of the casing and driven out of the casing through the side opening.

2. The heat dissipation fan as claimed in claim 1, wherein the layer of stuffing material comprises a pad made of a soft material.

3. The heat dissipation fan as claimed in claim 1, wherein the stuffing material comprises a gel-like substance supported on the bottom wall.

4. The heat dissipation fan as claimed in claim 1, wherein the stuffing material comprises a paste-like substance supported on the bottom wall.

* * * * *